US007508739B2

(12) United States Patent
Paes

(10) Patent No.: US 7,508,739 B2
(45) Date of Patent: Mar. 24, 2009

(54) MEASUREMENT SYSTEM

(75) Inventor: Wolfgang Paes, Radevormwald (DE)

(73) Assignee: Probe Factory GmbH, Ismaning (DE)

( * ) Notice: Subject to any disclaimer, the term of this patent is extended or adjusted under 35 U.S.C. 154(b) by 0 days.

(21) Appl. No.: 10/563,889

(22) PCT Filed: Jul. 12, 2004

(86) PCT No.: PCT/EP2004/007670

§ 371 (c)(1),
(2), (4) Date: Apr. 2, 2007

(87) PCT Pub. No.: WO2005/005000

PCT Pub. Date: Jan. 20, 2005

(65) Prior Publication Data

US 2007/0258333 A1 Nov. 8, 2007

(30) Foreign Application Priority Data

Jul. 10, 2003 (DE) ..... 103 31 447

(51) Int. Cl.
*G04F 10/00* (2006.01)
*G04B 47/00* (2006.01)
*A63B 71/00* (2006.01)

(52) U.S. Cl. ..... 368/113; 368/10; 368/2; 700/91; 235/377; 377/20; 340/323 R

(58) Field of Classification Search ..... 368/113, 368/2, 10; 463/36; 473/422; 340/323 R; 482/1–9; 700/91; 377/20; 235/377
See application file for complete search history.

(56) References Cited

U.S. PATENT DOCUMENTS

| | | | | |
|---|---|---|---|---|
| 4,074,117 | A | | 2/1978 | DeLorean et al. |
| 4,645,458 | A | * | 2/1987 | Williams ..... 434/251 |
| 5,241,487 | A | * | 8/1993 | Bianco ..... 702/178 |
| 5,511,045 | A | * | 4/1996 | Sasaki et al. ..... 368/2 |
| 5,812,049 | A | | 9/1998 | Uzi |

FOREIGN PATENT DOCUMENTS

| | | |
|---|---|---|
| BE | 894672 | 1/1983 |
| WO | WO 88/05323 | 7/1988 |
| WO | WO 90/11108 | 10/1990 |
| WO | WO 01/70345 | 9/2001 |

* cited by examiner

*Primary Examiner*—Vit W Miska
*Assistant Examiner*—Sean Kayes
(74) *Attorney, Agent, or Firm*—Pandiscio & Pandiscio

(57) ABSTRACT

This invention relates to a measurement system for determining the running time that a person need to run over one of a plurality of selectable different out-and-back courses, departing from a common starting point that is the finish point at the same time, wherein different turning points are provided by which the particular out-and-back course to be run is established. The times consumed are detected and evaluated individually.

21 Claims, 5 Drawing Sheets

MEASUREMENT SYSTEM

Figure 1:
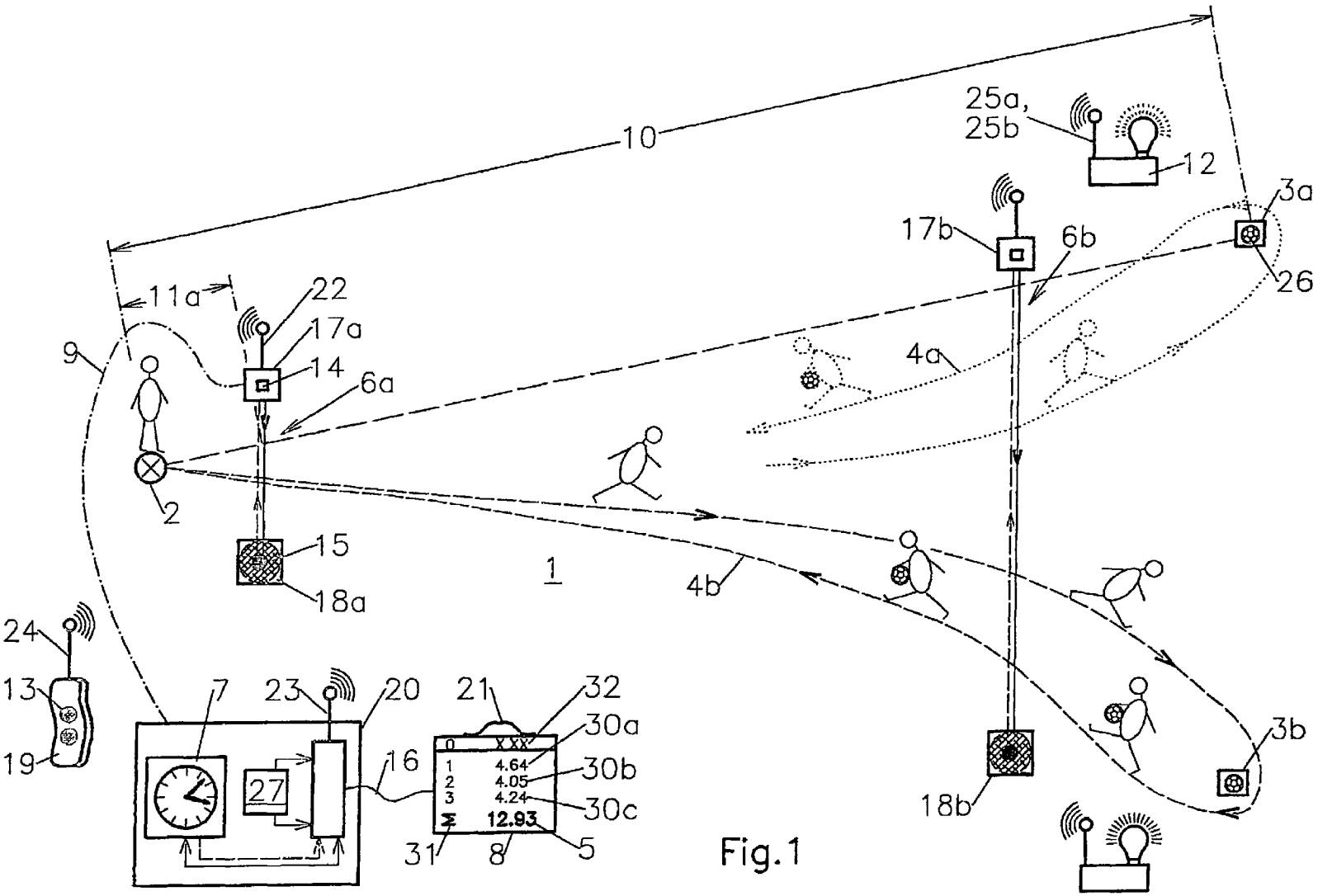

This invention relates to a measurement system for determining the time that a person needs to run over one of a number of selectable different out-and-back courses.

The invention is in the field of active sports activities of children, youths, and adults.

As far as that is concerned, it is known how to determine the time needed to run through a given course segment by a manually or automatically triggered measurement system and then to compare with one another the values determined for different persons.

It is important in that respect for each course traversed by each participating person to be of the same length, so that it is directly possible to compare their physical and sporting performance.

However, with these known measurement systems consisting of a course segment and a timing device located between the beginning and the end of the course, only the so-called sprint time can be determined, or in the long-distance range the total time, which naturally also encompasses the times needed to make up the long-distance speeds.

Time segments that are needed for given movements such as reversing direction or the like, for example, cannot be determined with the known measurement systems.

It is therefore the purpose of this invention to describe methods with which the sports capabilities of individual persons can be evaluated more accurately by simple running and maneuverability/skill training, wherein the comparability of personal results is nevertheless to be retained.

The invention achieves this objective with the features of the main claim.

The invention provides the advantage of a broad field of sports activities in which physical maneuverability, reaction time, braking time, acceleration time, and the like can be determined precisely, and with the aforementioned personal times even being comparable with one another for different persons.

From this arises the advantage that along with a sprint segment, selective training can be carried out along the out-and-back course, for example the maneuverability needed when playing tennis and the movements necessary for slowing down and speeding up.

To that extent it is not yet known how to document an advance in training and optionally train selectively for a turning motion, for example, by direct time measurement.

Since the invention in particular also envisions multiple different out-and-back courses, of which only a single one is to be run per measurement cycle, even the particular clockwise or counterclockwise maneuverability can be determined directly.

It is important for all of the out-and-back courses in question to have a common starting and finish point.

This means that the particular person has to run the out-and-back course beginning at the starting point, and has to turn around to reach the finish point.

Starting from there, the turning points of the individual different out-and-back courses lie within an angular range of up to 140°, for example, so that the individual turning points can be viewed at the same time from a single position.

Devices for producing measurement pulses are provided between the starting and finish point and the individual turning points, using which a timing clock associated with the measurement system is connected so that it starts when first passed, and stops at the last pass. In this way, the total time that is necessary to run over the particular out-and-back course can be determined accurately.

The measurement pulses in principle can also be triggered by appropriately trained persons. It is sufficient in this regard for the particular person running the out-and-back course in each case to get into the angle of view of the measuring person along a prescribed line, and for the measurement pulse to be triggered immediately thereafter, for example by a manually operated pushbutton.

For the particular results of measurement to be able to be compared directly with one another, depending on the particular direction of running, the distances between the starting and finish point and the individual turning points should all be the same as one another. Adherence to equal distances between the starting and finish point and the individual turning points as well as the measurement points can be integrated into the measurement system, preferably so that the measurement system goes into the measurement cycle only when a prior distance measurement has been made.

In the case of a measurement system with only two turning points, an isosceles triangle is obtained, each of whose long sides of equal length corresponds to the connecting line between the starting and finish point and one of the two turning points.

If there are more than two turning points, they should appropriately lie at the corners of an equilateral polygon.

If results are to be obtained that are unequivocally comparable with one another, the distances between the points at which the measurement pulses are produced for each out-and-back course and the starting and finish point should all be equal.

A single place for producing the measurement pulses can be provided for the invention. In this case, the measurement pulse to start the timing clock is produced when this place is first passed, and the stop pulse is produced when it is passed again.

A refinement provides that a measurement pulse is produced with a first device just beyond the starting and finish point, and a measurement pulse is produced when another device just before the turning point is first passed. This second measurement pulse is needed to determine the turnaround time at the turning point, since the person in question has to pass the second device again just beyond the turning point—but in the opposite direction.

When the device mentioned first is then passed again on the way back to the starting and finish point, the total time of the reversal is thus also determined.

Advantageous refinements are found from the subclaims.

The features of claim 8 are particularly significant.

According to this, an optically or acoustically perceptible signaling device is associated with each turning point, and the different signaling devices can be turned on and off independently of one another.

A transmitter is needed for this purpose; of all possible signals, it transmits to only a single signaling device the command also to indicate the signal.

This measure serves the purpose of also determining the reaction time of the person in question that is needed to depart on the way for one or the other of the possible out-and-back courses.

Since the turning points are all at a predetermined angle from one another with respect to the starting and finish point, the person in question therefore has to decide, before starting, the direction in which he has to start running. Therefore, possible deficits in the ability to differentiate right and left spontaneously can also be recognized selectively, and can optionally be reduced by appropriate training.

This measure is assisted by a device with which the different signaling devices can be turned on unpredictably and arbitrarily, for which it should be always be possible for only one of the signaling devices to be activated, but not the others.

It is suitable to this end to connect the signaling devices through a transmitter designed as a random number generator, so that after a certain activation time, only one of the signaling devices suddenly and unexpectedly in each case emits the signal to start running in the direction determined by the signaling device.

Additional reaction speed is required when the signaling devices are the same as one another and emit identical signals, since the directional association for the out-and-back course to be run is then established only with the mental conversion of the signal detected by the senses.

A refinement of the invention contributes to avoiding cables on the ground and thus to reducing the risk of accidents, by providing that the devices for producing the measurement pulses contain contactless trip mechanisms.

If they are light barriers, these are interrupted by running through them and the measurement pulse is produced in this way, for example by closing the corresponding contact. These measurement pulses can preferably be transmitted by wireless means.

A refinement of the invention provides that the times detected by the timing clock are visualized on a display panel. The personal times or times not related to persons can optionally also be stored in an electronic memory and evaluated. It can also be provided that the measurement results obtained here are output to a printer and given to the participating persons as documents, so to speak.

The measurement system pursuant to the invention is not limited to a single location.

To this end, it is proposed to make the individual components such as the timing clock and optionally also the display panel, and also the signaling devices if there are any, as portable units that can be set up independently of one another on the training ground, the tournament court, or at some other suitable place. The individual components advantageously have surfaces to which a ribbon advertisement, the logo of a sponsor, or the like can be attached for clear visibility.

As far as that goes, another refinement of the invention also deserves special notice, in which the communication connection between the individual components occurs by wireless signal transmission.

If it is also wanted to determine personal skillfulness, it is proposed that one or more hand tokens to be picked up and optionally carried by the particular person be provided at each turning point or in the course of each out-and-back course. These can be wooden sticks, balls, rings, or the like, that the particular person has to slow down appropriately, and stoop to pick up, and then to speed up again to full speed.

The invention will be described in further detail below with reference to examples of embodiment.

Figure 2:
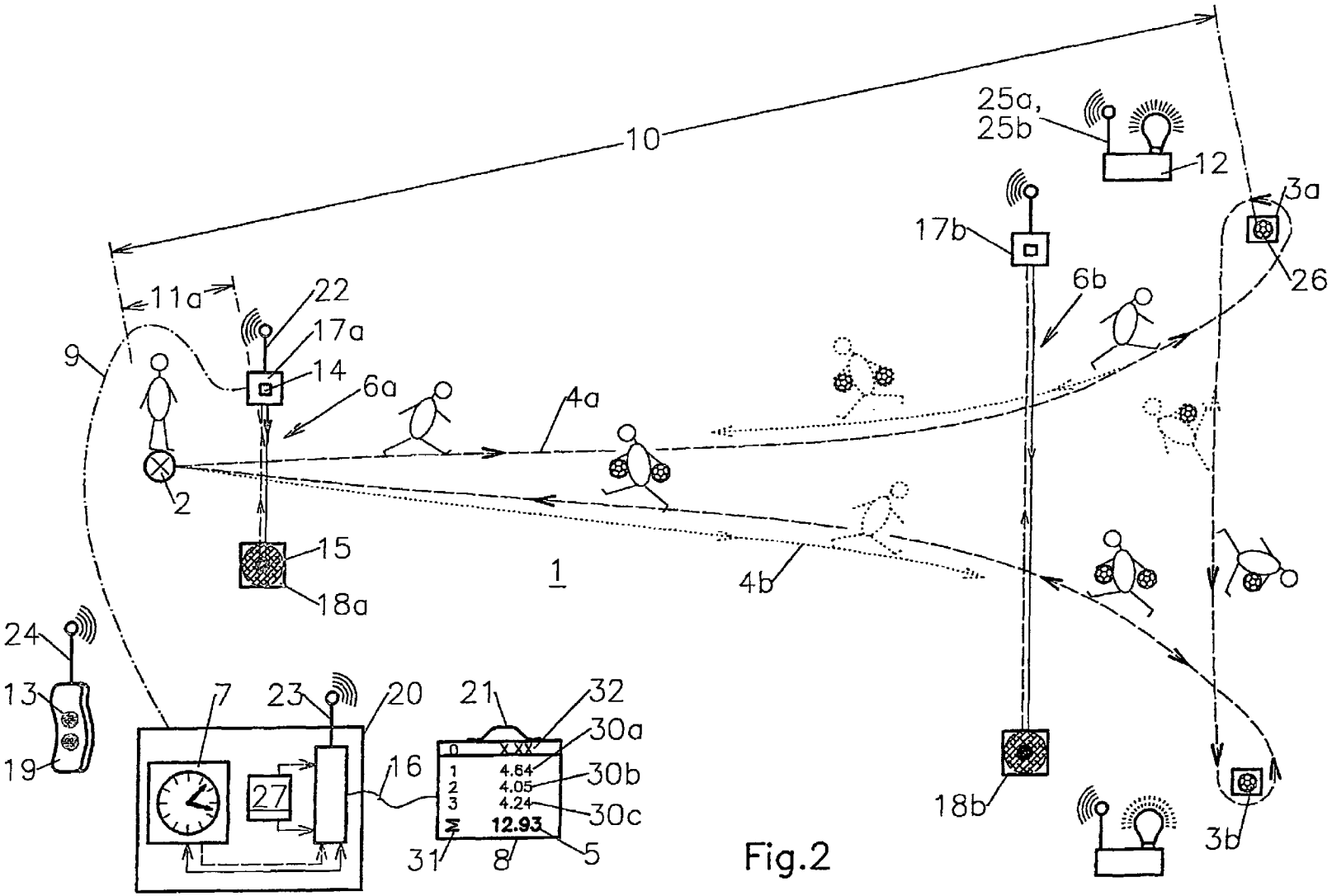
Figure 3:
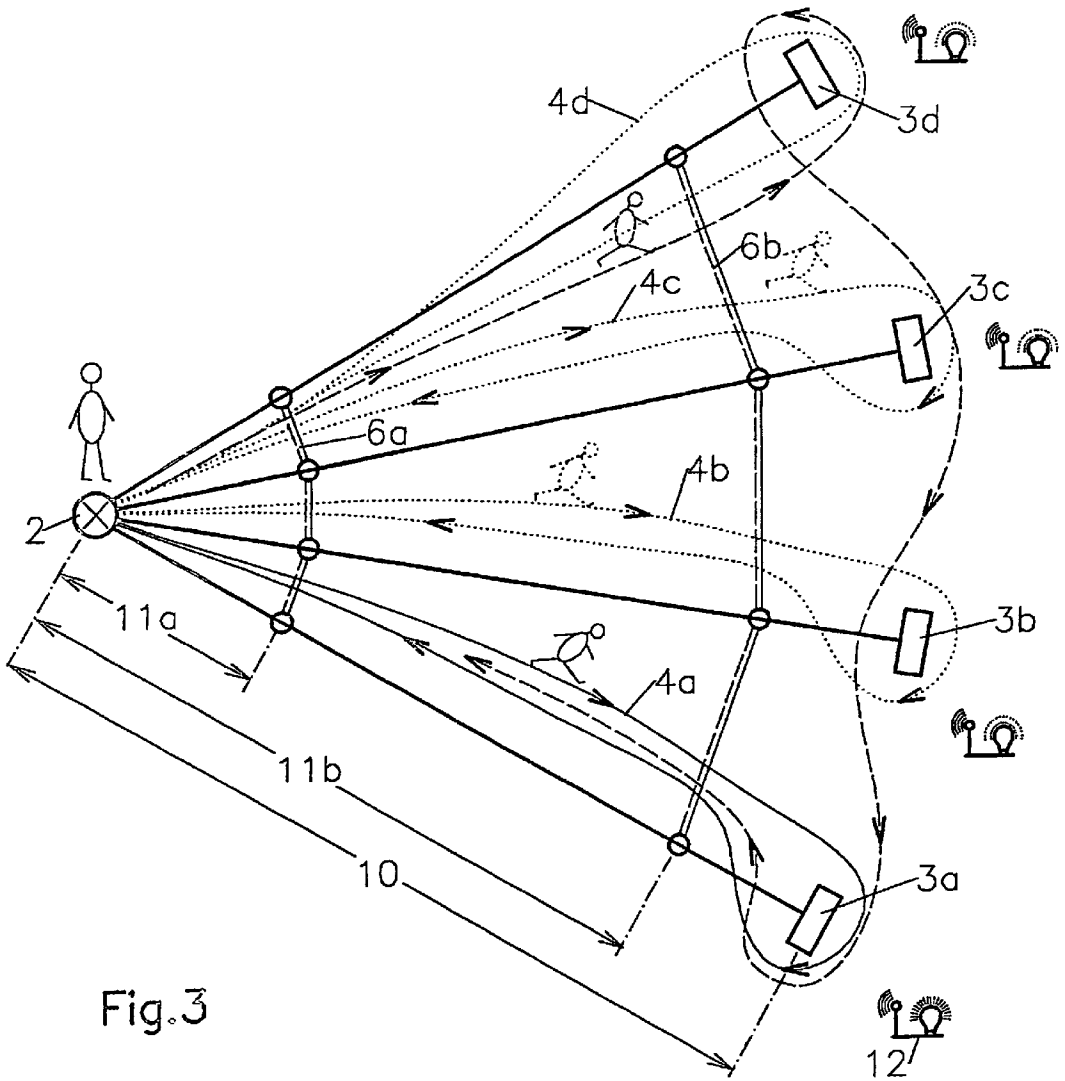
Figure 4:
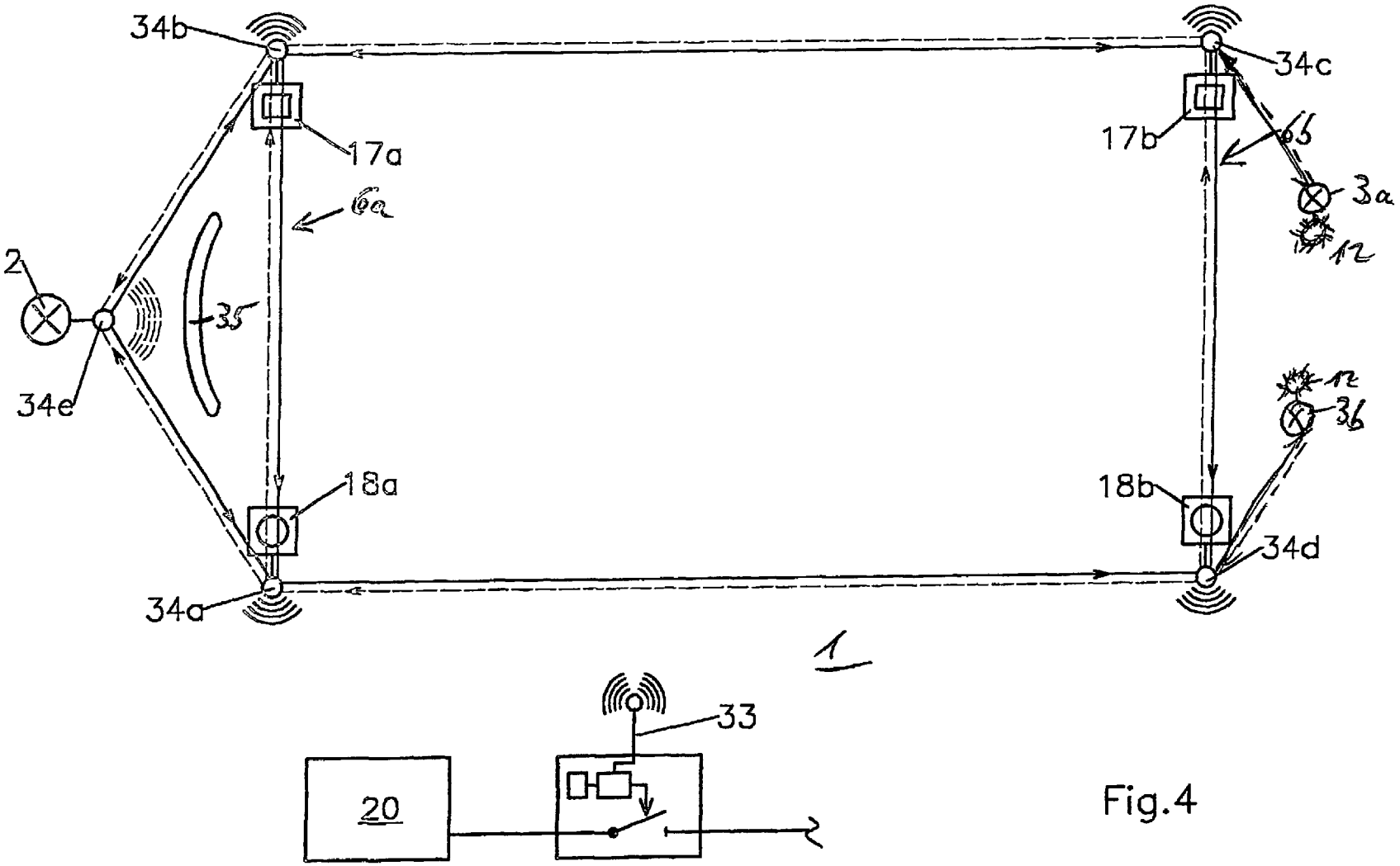

The Figures show:

FIG. 1 a first embodiment of the invention with only two turning points;

FIG. 2 another embodiment of the invention with out-and-back courses that differ from the out-and-back courses in FIG. 1;

FIG. 3 another embodiment of the invention with more than two turning points;

FIG. 4 a refinement with integrated device for distance measurement; and

Figure 5:
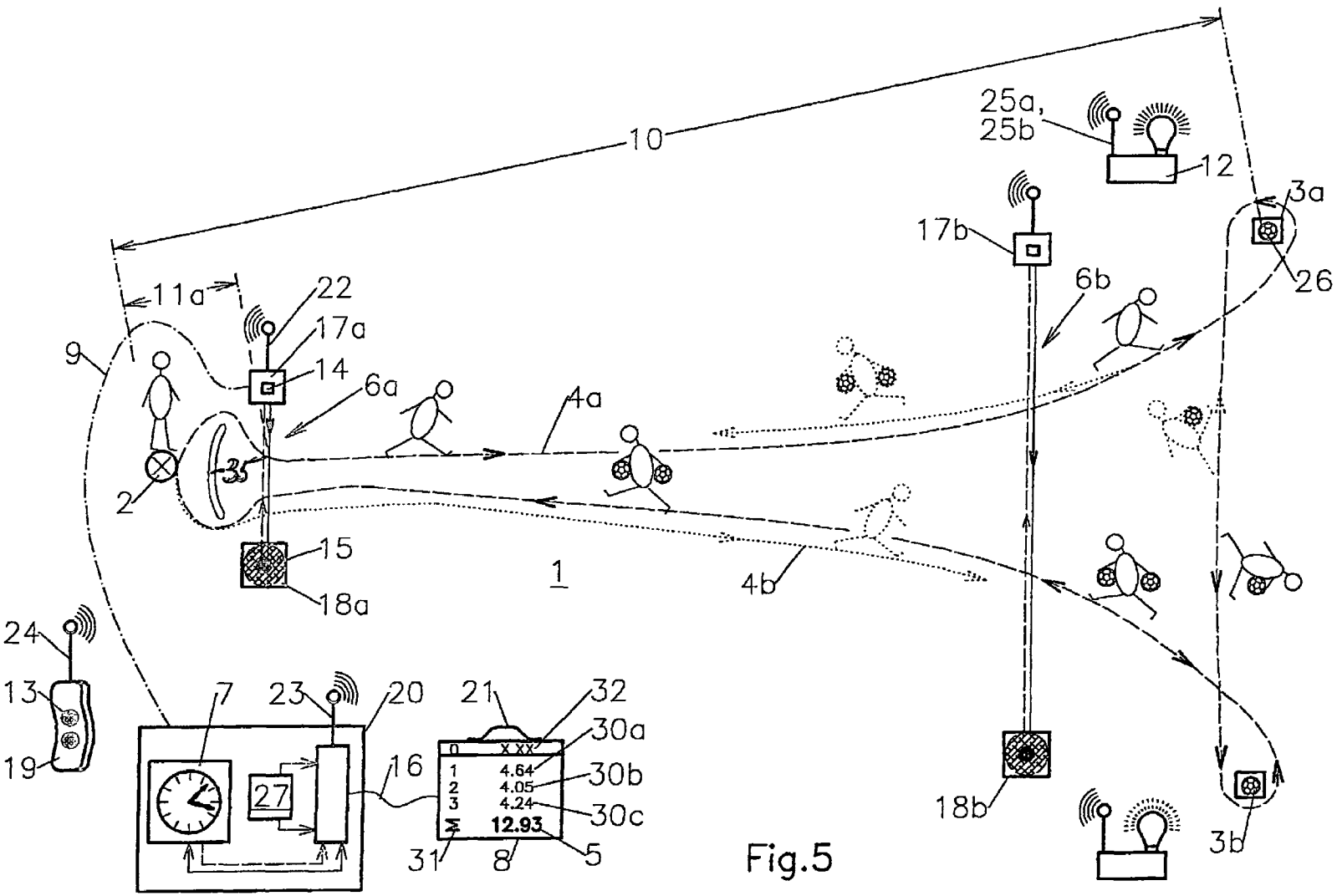

FIG. 5 a refinement of the embodiment according to FIG. 1.

If not otherwise stated below, the following description applies to all of the Figures.

The Figures show a measurement system 1 according to this invention.

Each of differently defined out-and-back courses 4*a*-4*e*, which a person not described in detail below is to run around according to the following description, stretches between a starting and finish point 2 and different turning points 3*a*-3*d*.

To this end, the turning points 3*a*-3*d* range in different directions from the starting and finish point 2, so that the turning points and thus also the shape of the out-and-back courses 4*a*-4*e* can be seen from the starting and finish point 2.

The person then has to run around one of the out-and-back courses upon a predetermined signal, and run around the associated turning point 3*a*-3*d*, and then return to the starting and finish point.

While the particular out-and-back course 4*a*-4*e* is being run, the time needed for it is determined.

For this purpose, devices 6*a*, 6*b* are provided to produce measurement pulses, which cross the particular path being run and produce a signal when the crossing point is passed, by which the timing clock 7 is turned on and off so that the total run time 5, the time needed to run out and back through the measured segment, is detected.

In principle, the total time that is needed to run around one of the out-and-back courses is to be determined in the sense of the invention.

For this purpose only a single device 6*a* is needed to produce the measurement pulses.

This device is located just beyond the starting and finish point and starts the timing clock 7 as soon as the person in question has passed through the intersection between the measurement line and the out-and-back course. After running around the turning point, the person in question turns back to this crossing point and thereby produces a measurement pulse when this crossing point is passed, which stops the timing clock started at the beginning, so that the total time needed can be read on the timing clock 7.

To supplement this, the timing clock 7 can be coupled with a display panel 8 so that the particular time(s) is/are shown clearly at a great distance.

A communication connection 9 between the device 6*a*, 6*b* for producing the measurement pulse and the timing clock 7 is necessary for this purpose.

In the simplest case, the communication connection 9 is set up through a signal transmission line (shown as a broken line) that is positioned as far as possible outside the out-and-back courses 4*a*-4*e*.

To guarantee the comparability of the measured results, the distances 10 that exist between the starting and finish point 2 and the individual turning points 3*a*-3*d* should be equal to one another. This assures that ultimately the time needed to run the out-and-back course is affected solely by the individual performance capability of the particular person. The individual prevailing distances can be monitored according to FIG. 4 by distance-measuring devices 34*a*-*e*, preferably by wireless communication, for example, between the portable light sources 17*a*, 17*b* and the reflectors 18*a*, 18*b*. The system is then switched to the measurement cycle by a receiver module 33 with switches communicating with the distance-measuring devices 34*a*-*e* only when the measured distances have been recognized is correct. The distance can be monitored regularly or randomly.

If there are more than two turning points 3*a*-3*d*, comparable measurements can be achieved if the turning points 3*a*-3*d* lie on the corners of a predetermined large equilateral polygon.

In addition, the distances between the points at which the measurement pulses are produced for each out-and-back course and the starting and finish point 2 should all be the same.

Since the points at which the measurement pulses are produced for each out-and-back course are inherently the intersections between the measurement lines and the out-and-back courses, it is assured in this way that all of the measurement pulses produced for the time measurement are always produced at the beginning and end of measured course segments that are the same for all of the out-and-back courses independently of the particular layout of the out-and-back course 4*a*-4*e*, so that comparability of the measured values is guaranteed in every case.

Although it is sufficient in principle to provide for only a single device 6*a* to produce the measurement pulses, the examples of embodiment show a refinement in which a first device 6*a* is located in the vicinity of the starting and finish point 2 to produce the measurement pulses, and a second device 6*b* is located in the vicinity of the turning points 3*a*-3*d*.

In this way, intermediate times can be determined at predetermined points on the out-and-back course 4*a*-4*e*, the information from which can reveal individual strengths and weaknesses.

Thus, for example, on the way from the starting and finish point to one of the turning points 3*a*-3*d*, the zero point of the time measurement is set by passing the first device 6*a* for producing the measurement pulses. At the end of the outward path to the turning point 3*a*-3*d* stands the second device 6*b* for producing a measurement pulse, so that when this second device 6*b* is passed on the way out, a first intermediate time 30*a* is measured that provides information on sprint capability. At the same time, an internal second time can be set at zero with this second measurement pulse to determine the time needed to run around the turning point 3*a*-3*d*, since the person in question on the return path on the out-and-back course again passes the second device 6*b* for producing a measurement pulse just beyond the turning point 3*a*-3*d* and triggers another measurement pulse. The time that passes between the last two measurement pulses is called the second intermediate time 30*b*, which provides information on maneuverability and skillfulness, while that for running the rest of the distance to the first device 6*a* for producing a measurement pulse permits determination of a third intermediate time by which the sprint capability can be evaluated. A figure for the sprint segment on the return path is obtained that differs from the sprint segment on the way out, since the runner passes the second device 6*b* on the return path at a higher speed than on the way out. The third intermediate time 30*c* and first intermediate time 30*a* show a difference that provides information on the acceleration capability of the runner.

By simple addition of the intermediate times 30*a*-30*c*, the total time 31 is obtained, which can likewise be utilized in the individual comparison of results.

In addition, the Figures show a refinement in which a signaling device 12 is associated with each turning point 3*a*-3*d* viewed from the starting and finish point 2.

The signaling device 12 emits an optically and/or acoustically perceptible signal. The individual signaling devices can be turned on and off independently of one another by a transmitter 13.

The reason and the purpose of these signaling devices 12 is to give a signal to the particular runner just before starting, as to which particular selectable out-and-back course 4*a*-4*e* he has to run. Therefore, the start signal with which the total time is put into action is combined with the appearance of the particular signal, so that the reaction time of the runner that he needs to start running in the appropriate direction is also measured.

The barrier 35 serves the purpose that the starting point 2 cannot be simply jumped through, but that the right-left reaction has to proceed first before starting to run.

In this case, therefore, an additional intermediate time would be taken into account that is a measure of the reaction time that the runner needs to observe the signaling devices and to decide which way he is to run.

When the first device 6*a* for producing a measurement pulse is passed through, the reaction time ends accordingly.

The total time needed to run through the course in the examples of embodiment is thus composed of four individual times, namely the reaction time from the output of the signal until the first device 6*a* for producing a measurement pulse is reached, the running time for the outward path between the first device 6*a* and the second device 6*b*, the turning time between the first pass through the second device 6*b* and the second pass through after running around the turning point, and the running time between the second device 6*b* and the first device 6*a* on the return path to the starting and finish point.

Accordingly, the figures on the display panel 8 would be supplemented for this refinement of the invention by the reaction time 32 shown dotted.

It is desirable if only one at a time of the signaling devices 12 can be switched in unpredictably and arbitrarily, while the other signaling devices can then no longer be activated.

A method that is technically simple to implement provides for a random number generator whose unpredictable output is used to generate a signal to turn on one of the signaling devices 12.

In the case of two signaling devices, for example, this can be an even or odd number, or zero or one.

The demands on reactivity are raised by the fact that the signaling devices are the same as one another and emit the same signals.

In addition, the Figures show examples of embodiment in which the devices for producing the measurement pulses 6*a*, 6*b* contain contactless trip mechanisms.

These are light barriers by which a light source 14 is aimed at a reflector 15. When the light beam is interrupted by the runner, the measurement pulse is triggered.

The devices 6*a*, 6*b* for producing the measurement pulses, the timing clock 7, and optionally also the display panel 8, as well as any signaling devices 12 that are present, are suitably designed as portable units that can be set up as such in the open or under cover.

This provides the advantage of a measurement system 1 that can be set up practically anywhere on training grounds, sports arenas, or the like, with the components making available additional advertising spaces that can be leased or sold to sponsors.

The particular components advantageously comprise functional units. Thus the components 17*a*, 17*b* can comprise just the light sources 14, while the components 18*a*, 18*b* can comprise the reflectors 15.

On the other hand, it is also conceivable for all of the light sources 14 and all of the reflectors 15 to be housed in a single case.

Furthermore, the Figures show a refinement in which the communication connection between the devices 6*a*, 6*b* for producing the measurement pulses and the timing clock 7 is wireless.

Therefore, there is constant radio contact between the devices 6*a*, 6*b* and the central control unit in which the timing clock 7 is installed.

Another radio contact exists here between the signal transmitters 12 and the central control unit, and additionally between the portable transmitter 13 that is made in the form of a hand-held instrument, and the signaling devices 12, so that in this case the complete system is in mutual wireless communication.

For this purpose, each of the portable components 17*a*-21 is equipped with a radio antenna 22-25*b*, and the central control unit in which the timing clock 7 is installed is wired correspondingly.

To supplement this, the Figures also show that a hand token 26 to be picked up and carried by the particular person is optionally associated with each turning point 3*a*-3*d*. This is stored at the particular turning point 3*a*-3*d* and has to be picked up while running around the turning point 3*a*-3*d* by the movements of slowing down, bending over, picking up, unbending, and speeding up, and brought to the starting and finish point 2.

As a supplement to this, the Figures also show an electrical circuit 27 that serves to detect, store in memory, and optionally evaluate the individual personal times.

This can readily be implemented by conventional computer technology. For this purpose, either an appropriate computer is integrated into the portable component 20 that contains the timing clock, or the portable component 20 has an interface that can be connected to an external computer.

As a supplement, the Figures also show that the individual out-and-back courses 4*a*-4*e* to be run can definitely be different.

While only a single turning point 3*a*-3*d* has to be circled for each out-and-back course in the example of embodiment of FIG. 1, two turning points in the embodiment of FIG. 2 would have to circled in a prescribed manner, but in different running directions.

The example of embodiment according to FIG. 3 in this regard shows other alternatives in which four out-and-back courses 4*a*-4*d* are available for selection, or alternatively also one out-and-back course 4*e* that includes all of the turning points.

The possible variations of the invention are almost unlimited and for that reason the examples of embodiment shown cannot represent a limitation of the invention.

Since the system is basically suitable for managing the measured individual and total times in the form of "best lists", for example, independently of the particular setup site, this results in the capability of "internal interlinking" of all existing systems to formulate district/federal/worldwide "best lists."

These "best lists" could be shown, for example, over the Internet on the website "speedflipper.com."

Of course, a prerequisite for this is the necessity for all of the systems at every location to be operated under unequivocally reproducible conditions.

Since it is also intended for the leaders of the "best lists" to be rewarded with winners' prizes, etc., there is a risk of cheating. Of course this risk can be minimized by enforcing compliance with competitive conditions.

To this end it is proposed that the distances of the two light barriers from one another and optionally also of the starting and finish point and of the turning points from the individual light barriers be monitored by the distance-measuring devices 34*a*-*e*.

This can preferably be done electronically.

Therefore, geometric parameters, for example distance segments, have to be determined that are unequivocal, easy to monitor, and that preclude operation of the system if they are changed.

This can be realized, for example, by additional distance sensors 34*a*-*e* that are connected to the central unit, to permit operation of the system only if the distances are in compliance.

These distances logically must be monitored permanently or randomly and unpredictably, to exclude manipulations of the system.

Furthermore, if the system is operated with an object to pick up at the turning point, to that extent transponder systems also come into consideration so that the reproducibility of the measurement results is also assured.

It can also be provided for conditions of competition, that a uniform ground covering be provided for all systems operated in competition.

LIST OF REFERENCE SYMBOLS

1 Measurement system
2 Starting and finish point
3*a*-3*d* Turning point
4*a*-4*e* Out-and-back course
5 Running time
6 First device for producing a measurement pulse
6 Second device for producing a measurement pulse
7 Timing clock
8 Display panel
9 Communication connection between 6*a*, 6*b* and 7
10 Distance between 2 and 3*a*-3*d*
11 Distance between 2 and 6*a*, 6*b*
12 Signaling device
13 Transmitter
14 Light source
15 Reflector
16 Connection between 7 and 8
17*a*, b Portable light source
18*a*, b Portable reflector
19 Hand-held transmitter
20 Portable timing clock
21 Portable display panel
22 Radio antenna for measurement pulse, transmitter
23 Radio antenna for measurement pulse, receiver
24 Transmitter radio antenna
25*a*, b Radio antenna for signaling device, receiver
26 Hand token
27 Electrical circuit
30*a* First intermediate time
30*b* Second intermediate time
30*c* Third intermediate time
31 Total time
32 Reaction time
33 Receiver module with switch
34*a*-*e* Distance-measuring device
35 Barrier

The invention claimed is:

1. A footrace time measurement system for determining time consumed in running a course and portions thereof selected from a plurality of courses and selected portions of the courses, wherein the plurality of courses have a common starting point;

the starting point comprises a common finish point for the courses;

each of the courses is an out-and-back course and is provided with a turning point, each of said courses extending along a centerline extending from the starting point, the centerlines extending in different directions;

a turning point signaling device is disposed adjacent each of the turning points;

said turning point signaling device comprises means for producing a signal indicating to a runner at the starting point which one of the plurality of courses is to be run;

measurement devices for producing measurement pulses are disposed between the starting point and each of the turning points, and between each of the turning points and the finish point, the measurement devices being adapted to produce a measurement signal when a runner passes the measurement device in a direction from the starting point to a turning point and in a direction from the turning point to the finish point; and a timing clock for indicating a start time at which the turning point signaling device initiates a signal, times at which the measurement devices are activated, and the finish time;

wherein for each of the courses there is a measurement device disposed proximate the starting and finish point and another measurement device disposed proximate the turning point.

2. Measurement system pursuant to claim 1, wherein distances between the starting point and the individual turning points are equal to one another.

3. Measurement system pursuant to claim 2, wherein there are more than two turning points that lie at corners of an equilateral polygon.

4. Measurement system pursuant to claim 1, wherein distances between the measurement devices at which the measurement pulses are produced for each out-and-back course and the starting and finish point (2) are all equal.

5. Measurement system pursuant to claim 1, wherein the distances between places at which the measurement pulse from the first measurement device is produced for each out-and-back course and the starting and finish point are equal.

6. Measurement system pursuant to claim 5, wherein the distances between the places at which the measurement pulse from the second device is produced for each out-and-back course and the particular turning points are equal.

7. Measurement system pursuant to claim 1, wherein viewed from the starting and finish points, an optically or acoustically detectable signaling device is associated with each turning point and the signaling devices are adapted to be turned on and off independently of one another by means of a transmitter.

8. Measurement system pursuant to claim 7, wherein only one at a time of the signaling devices can be turned on unpredictably and arbitrarily.

9. Measurement system pursuant to claim 8, wherein the signaling devices can be turned on by a transmitter comprising a random number generator.

10. Measurement system pursuant to claim 7, wherein the signaling devices are the same as one another and emit the same signals.

11. Measurement system pursuant to claim 7, wherein the connection between the transmitter and the signaling devices is wireless.

12. Measurement system pursuant to claim 1, wherein the devices for producing the measurement pulses contain contactless trip mechanisms.

13. Measurement system pursuant to claim 12, wherein the contactless trip mechanisms are light barriers.

14. Measurement system pursuant to claim 1, wherein the said timing clock is connected to communicate with a display panel.

15. Measurement system pursuant to claim 14, wherein the said devices for producing the measurement pulses, the timing clock and any display panel, as well as any signaling devices, are portable units that can be set up outdoors and under cover.

16. Measurement system pursuant to claim 1, wherein a communication connection between the devices for producing the measurement pulses and the timing clock, is wireless.

17. Measurement system pursuant to claim 1, wherein a hand token to be picked up and carried by a runner is associated with each turning point.

18. Measurement system pursuant to claim 1, wherein an electrical circuit is provided to detect, store, and optionally interpret the times for completion of a course and portions thereof.

19. Measurement system pursuant to claim 1, wherein individual components of the measurement system are adapted to be provided with advertising spaces.

20. Measurement system pursuant to claim 1, wherein distance-measuring devices between measurement points act together with a receiver module so that a measurement cycle is activated only at selected distances between prescribed measurement points.

21. Measurement system pursuant to claim 1, wherein a barrier that cannot be crossed by a runner is disposed between the starting and finish point and a first measurement point.

* * * * *